US005735684A

United States Patent [19]

Tsai

[11] Patent Number: 5,735,684

[45] Date of Patent: Apr. 7, 1998

[54] GAS PISTOL WITH REVERSE FLOW HEATING DEVICE

[76] Inventor: Chin-Lin Tsai, 3F, No. 94, Sec. 4, Chung Hsin Rd., San Chung City, Taipei Hsien, Taiwan

[21] Appl. No.: 822,353

[22] Filed: Mar. 20, 1997

[51] Int. Cl.[6] ..... F23D 11/44

[52] U.S. Cl. ..... 431/242; 431/247; 431/255; 431/344

[58] Field of Search ..... 431/242, 247, 431/255, 344

[56] References Cited

U.S. PATENT DOCUMENTS 4,726,767 2/1988 Nakajima ..... 431/255
5,466,149 11/1995 Tsai ..... 431/255

*Primary Examiner*—Carroll B. Dority
*Attorney, Agent, or Firm*—Bacon & Thomas

[57] ABSTRACT

An improved gas pistol with reverse flow heating device including a base, a support device, a piezo electric device, an air control device, a reverse flow heating device, an ejection device and an outer tube. In use, an insert ring is coupled to a gas container so that a conical pin in a neck ring urges against a gas valve of the gas container to release the gas, which flows via an inverted-L shaped hole at one side of the conical pin into a neck channel into a sleeve. By turning a control rod to adjust the flow of gas and to cause it to pass through an insert mount, a heating tube and a nut hole into a securing nut, the gas is vaporized and then passed through a relay tube to be ejected through a gas nozzle. At the instant when the gas is ejected, an air adjustment knob may be turned to adjust the amount of induced air to help combustion. Gas and air are mixed in a mixing tube, and the mixture is pushed to a flame nozzle and ejected through a jet hole and a plurality of primary flame holes. By pressing a push button and a piezo electric element, the static sparks generated by the electric wire may be transmitted to the jet hole and the flame holes to ignite the mixture.

12 Claims, 3 Drawing Sheets

GAS PISTOL WITH REVERSE FLOW HEATING DEVICE

BACKGROUND OF THE INVENTION

1. Field of the Invention

The present invention relates generally to a gas pistol, and more particularly to an improved gas pistol with a reverse flow heating device, which may be quickly assembled and by which fuel gas may be completely vaporized to help achieve complete combustion.

2. Description of the Prior Art

Heating or burning devices utilizing containerized gas are available in two main types. The first type is disclosed in the inventor's U.S. Pat. No. 5,466,149, in which a gas valve at the top of a gas container is connected to a fill nozzle at the bottom of a heating torch so that containerized gas in the container may be filled into the gas tank to provide the gas release means and flame generating means with gas. Another type is described in U.S. Pat. No. 4,804,324 to Prince Industrial Development Co., Ltd. A support device is disposed at the lower end for pivotal connection with a gas container so that the liquefied gas in the container may become vaporized to supply a burning means with the necessary gas for welding, soldering or other hot gas operations.

In general, after the gas pistol is connected to the gas container and the gas control device is opened, the user only needs to press the piezo electric device or to light the flame nozzle with fire so as to proceed with the burning operation. In using gas pistols, users will normally place turn the gas pistol and the gas container upside down. Due to liquid pressure, the liquefied gas inside the container may be ejected without going through the vaporization process. As a result, combustion is incomplete or the flame is extinguished.

In view of the above drawbacks, manufacturers have devised a reverse flow device in the gas path of the gas pistol. Essentially, the reverse flow device comprises a shaft hole formed in the center of a relay shaft to be connected to the known gas path. The other end of the shaft hole communicates with an oblique passage which is in turn linked to an intake tube at one end of the reverse flow tube so that liquefied gas may pass therethrough and enter another intake tube that is pivotally connected to the first intake tube in a parallel relationship. The gas then flows into the relay shaft via a channel connecting the second intake tube and the relay shaft then through an outlet formed at the other side of the shaft hole (shaft hole not communicating with outlet). The completely vaporized gas is then transported to an ejection device behind to help achieve complete combustion.

Since the relay shaft has to be provided with the shaft hole and the outlet on both sides, and the shaft hole has to communicate with the oblique passage while the outlet has to communicate with the oblique channel, the processing steps are very complicated. Precision is also required in making the relay shaft since slight error may result in communication between the shaft hole and the outlet, which may lead to incomplete vaporization of the gas as it cannot be passed through the reverse flow path.

SUMMARY OF THE INVENTION

A primary object of the present invention is to provide an improved gas pistol with a reverse flow heating device to eliminate the drawbacks with the prior art.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
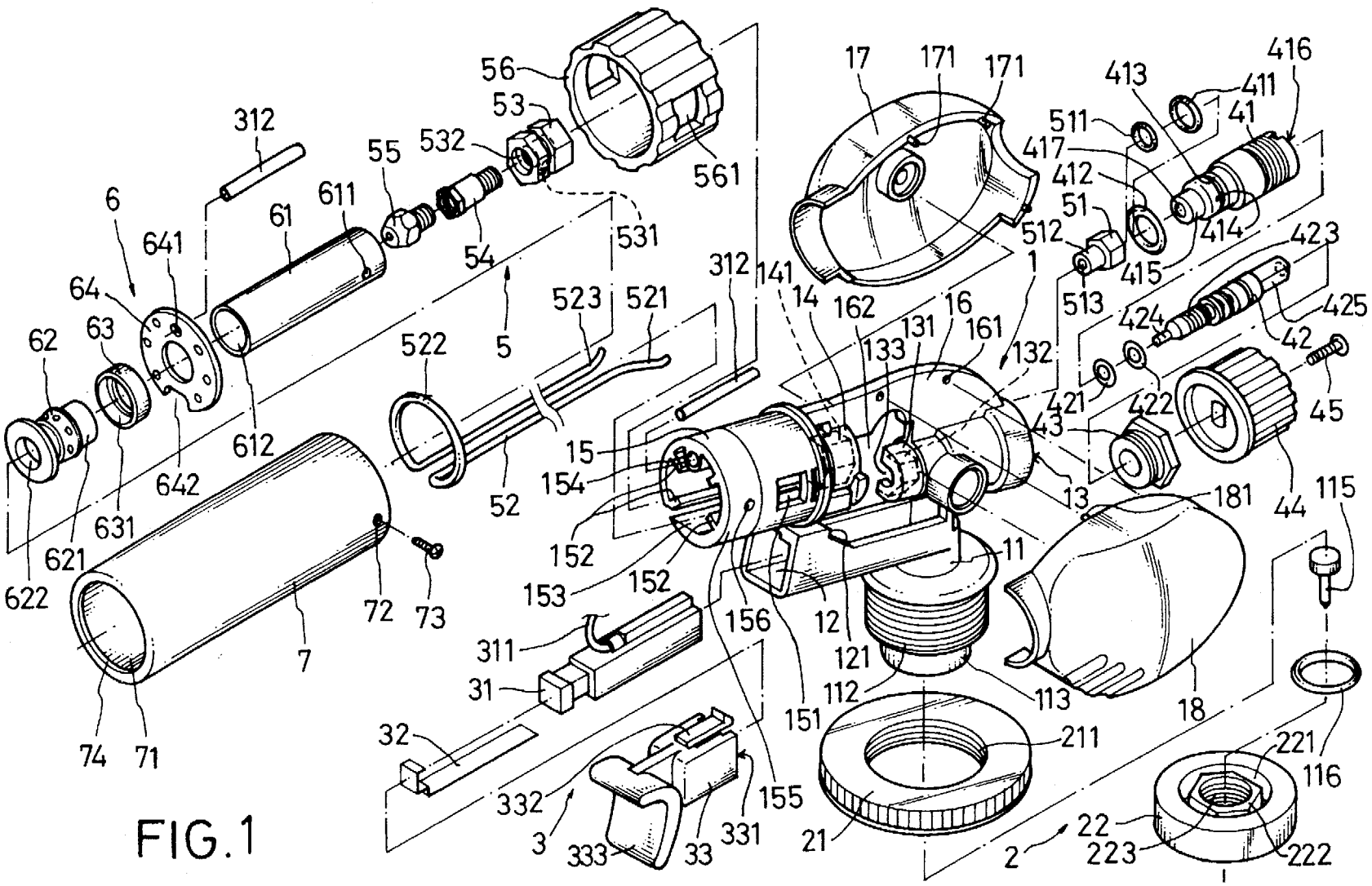
FIG. 1 is a schematic elevational exploded view of the gas pistol according to the present invention.
Figure 2:
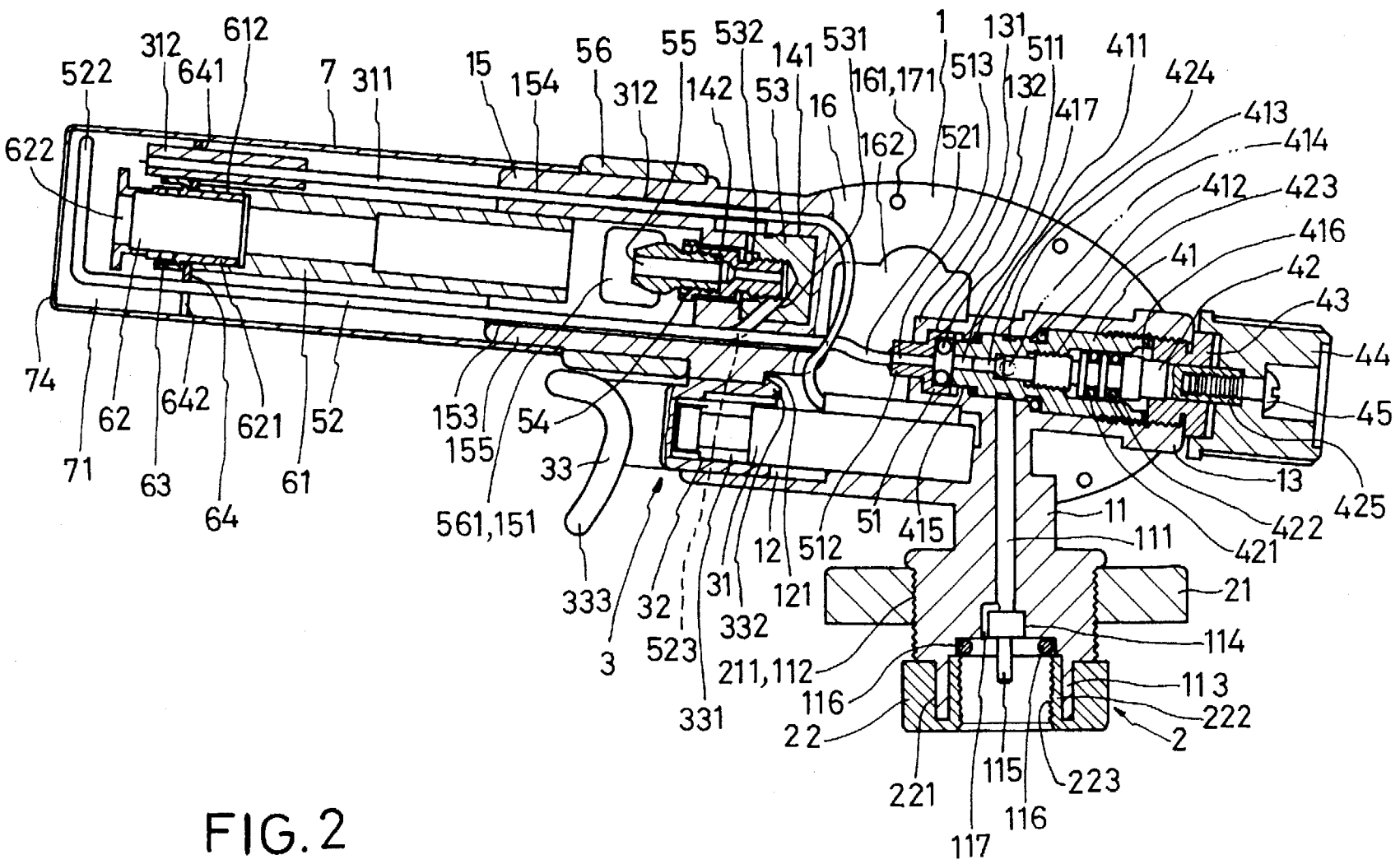
FIG. 2 is an assembled schematic sectional view of the present invention.

With reference to FIGS. 1 and 2, the present invention essentially comprises a base 1, a support device 2, a piezo electric device 3, an air control device 4, a reverse flow heating device 5, an ejection device 6 and an outer tube 7.

The base 1 is substantially a T-shaped structure with a slightly slanting upper portion. A neck 11 disposed at the lower portion thereof is internally provided with a through neck channel 111 and externally provided with a plurality of threads 112. The bottom rim of the neck 11 extends downwardly to form a neck ring 113 which appears circular on the outside but is a polygonal hollow structure inside to facilitate joining with the support device 2. The upper portion of the inner wall of the neck ring 113 has a protrudent hole 114 in which is insertably fitted a conical pin 115 and an O-ring 116. One side of the conical pin 115 has an inverted-L hole 117 communicating with the neck channel 111 for passage of gas or liquefied gas. In addition, the upper portion of the neck is provided with an elongated piezo electric groove 12 and a baffle wall 121 thereabove for receiving and position the piezo electric device 3. Furthermore, there is provided a slot 13 at an upper portion to the rear of the piezo electric groove 12 for accommodating the air control device 4. A front portion of the slot 13 extends outwardly to form a projection 131 which is internally provided with a first polygonal hole 132. A substantially U-shaped opening 133 of a relatively small size is formed at a front rim of the projection 131. Opposite to the projection 131 is disposed a tubular projection 14 which is internally provided with a second polygonal hole 141, and a tubular hole 142 is formed at the front portion of the second polygonal hole 141 for accommodating and positioning the reverse flow heating device 5. At the outer side of the tubular hole 142 is provided a post 15 of a relatively large diameter. At opposite ends of the post 15 are respectively provided an air intake slot 151, whereby after the post 15 is fitted with an adjustment knob 56, amount of air entering may be regulated. In addition, the annular inner wall of the post 15 is provided with three or more ribs 152 slanting inwardly for fitting with the ejection device 6. The bottom side of the post 15 is a planar surface 153 which may facilitate mounting of a heating tube 52. Additionally, the inner wall at the upper portion of the post 15 is provided with a hole 154 for passage of an electric wire 311 of the piezo electric device 3. The outer rim thereof has a fitting end 155 and is provided with a lock hole 156 for locking with the outer tube 7. In order to conceal both sides of the base 1 so as to enhance the appearance of the present invention, a plurality of wing holes 161 are formed on a wing 16 connected between the post 15 and the slot 13. A left shell 17 and a right shell 18 are respectively provided with mounting posts 171 and 181 matching the wing holes 161 so that they may fit onto the wing 16 from either side. A screw is then passed through the left shell 17 and a hollowed portion 162 below the wing 16 to lock in the right shell 18.

The support device 2 is locked to the threads 112 of the base 1 by a securing ring 21 having a plurality of threads 211 at the central portion. The neck ring 113 on the other hand is fitted with an insert ring 22. The insert ring 22 internally has a non-through circular groove 221, and a vertically oriented polygonal column 222 at the center, for tight connection with the neck ring 113. When the securing ring 21 screwably engages the neck 11, the neck ring 113 may be caused to slightly retract and tightly grip the polygonal column 222 so that they cannot be separated. In addition, the center of the polygonal column 222 is provided with a threaded section 223 for pivotal connection with a gas container. When the gas container is connected to the support device 2, it will be subjected to the pressure of the conical pin 115 so that gas or liquefied gas is ejected from a spout at one side and passes through the inverted-L shaped hole 117 and the neck channel 111 into the slot 13.

The piezo electric device 3 essentially comprises a piezo electric element 31 and an electrically conductive plate 32 fitted therewith, which are together fitted into the piezo electric groove 12. The electric wire 311 at the upper side of the piezo electric element 31 is passed through the hole 154 of the post 15, or is fitted with a thermally insulated tube 312 within the hole 154. In order to prevent the piezo electric element 31 from slipping out, the open end of the piezo electric groove 12 has a push button 33 inserted therein. The push button 33 has an opening at its rear end for receiving the piezo electric element 31. The upper side of the push button 33 is provided with a hook 332 for hooking the baffle wall 121 to prevent the push button 33 from slipping out of the piezo electric groove 12. And in order to facilitate pressing by users, the front end of the push button 33 may be provided with a curved press arc 333.

The air control device 4 is a rotary knob type structure. It essentially comprises a sleeve 41 fitted with two respective O-rings 411 and 412 before being locked to the slot 13. The front end of the sleeve 41 has a groove 413 for matching the neck groove 111. A groove hole 414 is provided at the upper part to allow passage of gas or liquefied gas into the sleeve 41. Additionally, the front end of the sleeve 41 is provided with an insert post 415 for connection with the reverse flow heating device 5. The sleeve 41 is internally provided with a stepped hole 416 for screwable connection with a control rod 42. The middle section of the control rod 42 is fitted with two respective O-rings 421 and 422. The front is a threaded section 423 and a pin 424. Therefore, when the control rod 42 screwably engages the sleeve 41, the control rod 42 may transversely displace within the sleeve 41 so that the pin 424 may control the opening or closing of a pin hole 417 (communicating with the stepped hole 416) inside the insert pin 415 to thereby control the connection of gas or liquefied gas. Furthermore, an end portion 425 at the rear end of the control rod 42 passes through a seal cap 43 and a rotary knob 44 before locking with a screw 45, so that when the rotary knob 44 is turned, the control rod 42 may be synchronously brought to transversely displace within the sleeve 41 to control the passage of gas.

The reverse flow heating device 5 is essentially comprised of an insert mount 51 of a polygonal shape having an O-ring 511 fitted therein before being insertably connected with the insert pin 415. It is fixedly disposed in the first polygonal hole 132 of the projection 131 such that a post 512 at its front end extends from the U-shaped hole 133. The post 512 has formed therein a groove 513 which communicates with the pin hole 417 to make gas connection. An intake tube 521 at one end of the heating tube 52 is welded to the post 512 so that after gas has passed through the intake tube 521, an annular tube 522 and an discharge tube 523, it may be locked in a nut hole 531 of a securing nut 53 to achieve a reverse flow path. The securing nut 53 is also polygonal so that it may be inserted into the second polygonal hole 141 of the tubular projection 14 to achieve positioning. Besides, the securing nut 53 has a non-through connecting hole 532 formed at a front end thereof. The connecting hole 532 is internally provided with a plurality of threads for locking with a relay tube 54, which is further connected to a gas nozzle 55 to form a gas flow path. After assembly, the gas nozzle 55 is located at the air intake slot 151 so that, at the instant fuel gas is ejected, the current generated thereby may induce air into the ejection device 6. For controlling the amount of induced air, the post 15 may be fitted with the adjustment knob 56 which has knob holes 562 for matching the air intake slots 151 so that, when the knob 56 is turned, the amount of induced air may be controlled depending on the area of that portion of the air intake slots 151 that is shielded.

The ejection device 6 essentially comprises a mixing tube 61 having fitting with the ribs 152 of the post 15. The mixing tube 61 is further provided with a connecting hole 611 at a position corresponding to that of the lock hole 156 so that it may be locked to the post 15. The mixing tube 61 has disposed therein a mixing chamber 612 where completely vaporized gas is mixed with air. Then a flame nozzle 62 is passed through a fire ring 63 and a securing ring 64. A connecting end 621 at the rear end of the flame nozzle 62 is insertably connected with the mixing chamber 612 so that the entire ejection device 6 may be secured on the post 15 of the base 1. Additionally, the center of the flame nozzle 62 has a jet hole 622 with a plurality of primary flame hole 623 at its peripheral surface so that the mixture of fuel gas and air may be ejected directly from the jet hole 622 or its periphery. The fire ring 63 has a stop rim 631 located at the outer edge of the primary flame holes 623 for compelling the primary flames to move forwardly. When the flame ignited at the jet hole 622 is extinguished by an external force, the primary flames will ignite the mixture ejected at the jet hole 622. The upper end of the securing ring 64 is provided with a through hole 641 for passage of the electric wire 311 or a electric wire with a thermally insulated tube 312. The naked end is disposed near the jet hole 62 so that static sparks generated by the piezo electric element 41 may be transmitted by the electric wire 411 to ignite the mixture at the jet hole 62. In addition, the bottom side of the securing ring 64 is provided with a notch 642 for passage of the heating tube 52.

The outer tube 7 is a hollow tubular structure having a passage 71 within for accommodating the ejection device 6 and the heating tube 52. It is also provided with a through hole 72 for matching the connecting hole 611 and the lock hole 156. By means of a securing screw 73 passing through the through hole 72, the connecting hole 611 to be locked in the lock hole 156, the outer tube 7, the ejection device 6 and the base 1 may be locked together. In addition, the front rim of the outer tube 7 slightly retracts inwardly to form a tube flange 74 to prevent the ejection device 6 and the heating tube 52 from slipping out.

Figure 3:
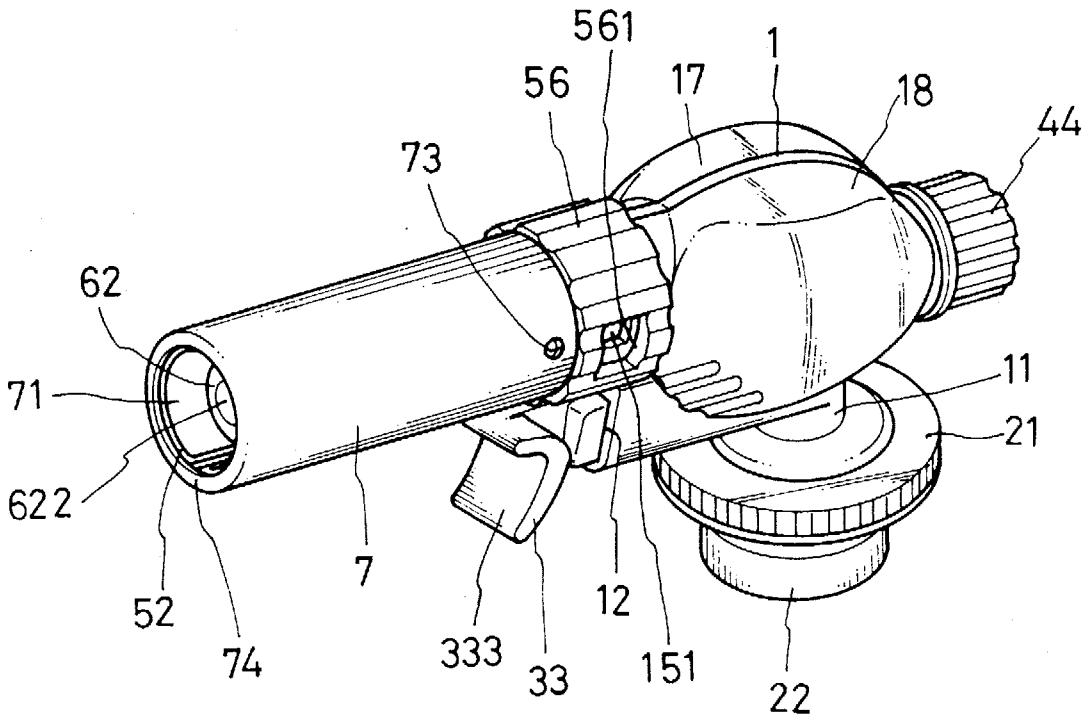
FIG. 3 is an assembled elevational view of the present invention.

The present invention thus assembled is shown in FIGS. 2 and 3. In use, the insert ring 22 is fitted to the gas container so that the conical pin 115 of the neck ring 113 may urge against the gas valve of the gas container to allow gas or liquefied gas flow via the inverted-L shaped hole 117 at the side of the conical pin 115 into the neck groove 111 through the groove 413 and the groove hole 414 into the sleeve 41. At this point, it is only necessary to turn the control rod 42 to adjust the amount of gas so that gas flows past the insert mount 51, the heating tube 52 and the nut hole 531 into the securing nut 53. The thus vaporized gas then passes through the relay tube 54 and ejected through the gas nozzle 55. At the instant when the gas is ejected, the adjustment knob 56 may be turned to adjust the amount of induced air to help combustion. Air is mixed with gas inside the mixing tube 61, and the mixture is transported to the flame nozzle 62 and ejected through the jet hole 622 and the primary flame holes 623. Then it is only necessary to press the push button 33 and the piezo electric element 31 to generate static sparks which are transmitted via the electric wire 311 to ignite the mixture at the jet hole 622 and the primary flame holes 623 to accomplish combustion.

Since the present invention provides the reverse flow heating device 5 to prolong vaporization period by passing incompletely vaporized gas or liquefied gas ejected by inversion of the gas container through the heating tube 52 in the circuit described above. In addition, after the flame nozzle 62 is ignited, the surrounding temperature may heat the annular tube 522 to speed up gas vaporization so that maximum combustion efficiency may be achieved.

When the gas pistol is not in use, the user may just turn the rotary knob 44 of the air control device 4 in a reverse direction to cause the control rod 42 inside the sleeve 41 to displace so as to close the pin hole 417 by using the pin 42, thus stopping gas supply. After residual gas in ejection device 6 has been completely burned up, the flame will automatically go out.

By means of the present invention, there is no need to provide a relay shaft as in the prior art. It is only necessary to have the intake tube at one end of the heating tube 52 connected to the insert mount 51 while the discharge tube 523 is connected to a securing nut 53 to form a gas reverse flow path. There is no need to make four or more holes in the relay shaft to achieve gas reverse flow. The present invention may thus effectively reduce processing and assembly steps.

In addition, since the insert mount 51 and the securing nut 53 are polygonal structures, and they are respectively inserted into the first polygonal hole 132 and the second polygonal hole 141, these holes having a size larger than the theoretical radius of the insert mount 51 and the securing nut 53, they can be tightly coupled. Preferably, the insert mount 51 and the securing nut 53 are hexagonal structure, and the first and second polygonal holes 132 and 141 should be correspondingly configured.

In summary, the present invention allows easy assembly and reduces processing steps. Fuel gas may be completely vaporized to facilitate combustion. Flames can be ignited again after being extinguished. Adjustment of gas flow and induced air may also be controlled.

Although the present invention has been illustrated and described with reference to the preferred embodiment thereof, it should be understood that it is in no way limited to the details of such embodiment but is capable of numerous modifications within the scope of the appended claims.

What is claimed is:

1. An improved gas pistol, comprising:

a base, said base being a substantially T-shaped structure, with a neck disposed at a lower portion thereof, said neck being provided with a through neck channel, a lower portion of said neck extending downwardly to form a neck ring, one side of an upper portion of said neck being provided with a slot, a front end of said slot being provided with a projection which has disposed therein a first polygonal hole and a U-shaped hole for accommodating and connecting a reverse flow heating device, the other side of the upper portion of said neck being provided with a tubular projection which is provided with a second polygonal hole and a tubular hole for accommodating and connecting said reverse flow heating device as well, an outer side of said tubular hole being provided with a post for providing a path for entrance of air;

a support device connected to said neck and said neck ring so that it may be pivotally connected to a gas container to guide gas into said neck channel;

an air control device connected to said slot and having tubes connected to said neck channel to form a passage, said air control device having a control rod the displacement of which may be utilized to control gas connection;

said reverse flow heating device having an insert mount whereby said reverse flow heating device is connected to said air control device to form a passage; said insert mount being inserted into said first polygonal hole, a mount post at one end of said mount being connected to an intake tube of a heating tube so that gas may pass through said intake tube, an annular tube and a discharge tube into a securing nut inside said second polygonal hole, said securing nut being connected in sequence with a relay tube and a gas nozzle and secured inside said tubular hole so that completely vaporized gas may pass through said relay tube and be ejected through said gas nozzle;

an ejection device, said ejection device being connected to said post of said base, completely vaporized gas being mixed with induced air in said ejection device before being ejected through a flame nozzle at a front end of said ejection device such that after a flame is ignited, the surrounding temperature after ignition may preheat said heating tube to achieve complete vaporization of gas; and an outer tube, said outer tube being connected to said post of said base and enclosing said ejection device and said reverse flow heating device.

2. An improved gas pistol as claimed in claim 1, wherein said neck is provided with a plurality of outer threads, and an upper portion of an inner wall of said neck ring is provided with a protrudent hole having a conical pin inserted therein and an inverted-L shaped hole, said inserted L-shaped hole communicating with said neck channel; and said support device utilizes a securing ring with a plurality of inner threads to screwably engage said threads of said neck, said neck ring extending in between an annular groove and a polygonal column of an insert ring so that said neck ring may grip said insert ring firmly without being separated therefrom, said polygonal column having a plurality of threads in the center for engaging a gas container so that gas may pass through said L-shaped hole indirectly into said neck channel.

3. An improved gas pistol as claimed in claim 1, wherein an upper portion of said neck is provided with an elongated piezo electric groove for accommodating a piezo electric device, said piezo electric device comprising a piezo electric element and an electrically conductive plate fitted to said piezo electric element, said piezo electric device being fitted with a push button before insertion into said piezo electric groove, an upper portion of said push button being provided with a hook for hooking a baffle wall pre-formed at an upper portion of said piezo electric groove so as to prevent said piezo electric device from disengaging from said piezo electric groove, an electric wire of said piezo electric element being passed through a hole of said post of said base and extending into said flame nozzle of said ejection device.

4. An improved gas pistol as claimed in claim 3, wherein said electric wire is fitted with a thermally insulated tube.

5. An improved gas pistol as claimed in claim 3, wherein said push button is provided with a curved push arc at a front end thereof to facilitate pressing.

6. An improved gas pistol as claimed in claim 1, wherein said a wing is disposed between said post and said slot of said base, said wing having a plurality of wing holes for receiving corresponding pins of two symmetrical shells fitted respectively onto both sides of said wing, screws being passed through one of said shells and a hollowed portion below said wing into the other of said shells to lock them together.

7. An improved gas pistol as claimed in claim 1, wherein said post of said base is provided with two opposite intake slots at its periphery, an air adjustment knob being provided for engaging said post, said air adjustment knob being provided with holes for matching said intake slots so that turning of said air adjustment knob may achieve regulation of amount of induced air.

8. An improved gas pistol as claimed in claim 1, wherein said post of said base is internally provided with three or more ribs disposed in a transverse direction for gripping a mixing tube of said ejection device so that air and gas may mix within a mixing chamber within said mixing tube, the end of said mixing tube and said post being respectively provided with a connecting hole and a lock hole so that screws may be used to lock them together, and the other end of said mixing tube being connecting to said flame nozzle so that the mixture of gas and air may be ejected through said flame nozzle.

9. An improved gas pistol as claimed in claim 8, wherein said flame nozzle is provided with a plurality of primary flame holes at its periphery, and a connecting end at a rear end thereof is passed through a fire ring and a securing ring to be insertably connected to said mixing chamber, said fire ring having an annular stop rim which is disposed at an upper rim of said primary flame holes, said securing ring having a through hole at an upper portion thereof for passage of said electric wire or an electric wire having a thermally insulated tube, said securing ring further having a notch at a lower portion thereof for passage of said heating tube.

10. An improved gas pistol as claimed in claim 1, wherein said outer tube is provided with a through hole for matching said connecting hole of a mixing tube for passage of a screw for locking purposes, a front rim of said outer tube retracting inwardly to form a flange for preventing said reverse flow heating device and said ejection device from slipping out.

11. An improved gas pistol as claimed in claim 1, wherein said insert mount and said securing nut are preferably hexagonal.

12. An improved gas pistol as claimed in claim 1, wherein said first polygonal hole and said second polygonal hole are both larger than the theoretical radius of said insert mount and said securing nut to facilitate insertable engagement.

* * * * *